United States Patent [19]

Friday

[11] Patent Number: 4,828,073

[45] Date of Patent: May 9, 1989

[54] MOBILE SUSPENDED SCAFFOLD

[76] Inventor: Ronald W. Friday, 310 Lillian Street, Thunder Bay, Ontario, Canada, P7A 1J2

[21] Appl. No.: 22,998

[22] Filed: Mar. 6, 1987

[30] Foreign Application Priority Data

Mar. 20, 1986 [GB] United Kingdom ..... 8606896

[51] Int. Cl.[4] ..... E04G 3/10

[52] U.S. Cl. ..... 182/36; 182/45; 182/150

[58] Field of Search ..... 182/36–38, 182/142, 150, 45, 143, 144, 222; 248/237

[56] References Cited

U.S. PATENT DOCUMENTS

| | | | |
|---|---|---|---|
| 647,381 | 4/1900 | Doehring | 182/36 X |
| 1,054,376 | 2/1913 | Weidrich | 182/36 X |
| 1,349,426 | 8/1920 | Kitsteiner | 182/150 X |
| 2,639,950 | 5/1953 | Wheeler . | |
| 3,066,757 | 12/1962 | Robinson et al. . | |
| 3,245,355 | 4/1966 | Cousins et al. . | |
| 3,282,377 | 11/1966 | Pfeiffer et al. . | |
| 3,391,757 | 7/1968 | Duke | 182/150 X |
| 3,854,550 | 12/1974 | Shingler . | |
| 4,074,789 | 2/1978 | Warren et al. | 182/37 |
| 4,234,055 | 11/1980 | Beeche | 182/142 X |
| 4,270,628 | 6/1981 | Anderson | 182/37 X |
| 4,454,818 | 6/1984 | Eccleston et al. . | |
| 4,558,764 | 12/1985 | Lorenz | 182/36 X |
| 4,646,877 | 3/1987 | Wham | 182/45 X |

FOREIGN PATENT DOCUMENTS

| | | | |
|---|---|---|---|
| 800338 | 9/1950 | Fed. Rep. of Germany | 182/150 |
| 2283280 | 8/1974 | France | 182/36 |

*Primary Examiner*—Alvin C. Chin-Shue

*Attorney, Agent, or Firm*—Murray E. Thrift; Stanley G. Ade; Adrian D. Battison

[57] ABSTRACT

A mobile suspended scaffold arrangement comprises a support portion which can move along rails or purlins provided on the roof of a steel building, a boom assembly extending outwardly therefrom and a scaffold hanger portion suspended from the boom assembly. The device is particularly for use in cladding prefabricated steel buildings. The wheel assemblies include a vertical support wheel and a horizontal guide wheel and can be coupled by simple elongate beams extending at right angles to the rails. The support portion on the roof can be divided into two separate dollies which can be used for transporting equipment on the roof. The support portion couples to the hanger portion both at a hook at the top of the beam and also at a bracket extending outwardly from one side of the support so as to clamp the hanger rigidly vertical to prevent twisting.

11 Claims, 7 Drawing Sheets

MOBILE SUSPENDED SCAFFOLD

BACKGROUND OF THE INVENTION

This invention relates to a mobile suspended scaffold arrangement particularly of a type which includes a support portion which can run on rails on the roof of a building with a scaffold portion carried on the support portion and suspended over an edge of the roof to lie along side a wall of the building for carrying out building operations on the wall and in the area of the junction between the wall and the roof.

Various arrangements of scaffold arrangement of this type have previously been proposed and in a search carried out in relation to the present invention the following U.S. patents were revealed: U.S. Pat. Nos. 3,854,550 - 2,639,950 - 1,054,376 3,245,355 - 3,066,757 - 3,454,818 - 4,074,789 and 3,282,377.

Of these prior patents probably the most relevant are U.S. Pat. No. 3,854,550 (Shingler) issued in 1974 and U.S. Pat. No. 4,074,789 (Warren et al) issued in 1978. The second of these patents shows a device which is arranged for rolling movement along the Z-shaped purlins of a building under construction. This patent shows a rolling arrangement on the purlins which includes what the inventor calls "force rollers" which run along the underside surface of a purlin to prevent the device toppling from the roof. Such an arrangement has a significant disadvantage in that it is difficult to apply to the rails or purlins and furthermore it is not suitable for use with rails or purlins of a different shape without significant modification.

The Shingler patent shows a device which runs on specifically mounted planks and uses a counterweight arrangement. However the construction of the wheel arrangement is not satisfactory for use on rails of different shapes and the unit is limited therefore in its use.

There remains therefore a requirement for a mobile scaffold of this type which is designed particularly but not exclusively for use in the assembly of steel buildings. According to a first aspect of the invention, therefore, there is provided a mobile suspended scaffold arrangement comprising a support portion for running along a roof of a building and a scaffold portion arranged to be suspended from said support portion along a side wall of the building, said support portion comprising a first wheel assembly for running along a first rail adjacent an edge of the roof, a second wheel assembly for running along a second rail parallel to the first and spaced on the edge of the roof, frame means interconnecting the first and second wheel assemblies so that the support portion forms a platform, each of said wheel assemblies comprising a first and second support wheel spaced longitudinally of the respective rail and each mounted for rotation about an axis parallel to the roof and having a periphery arranged to run on an upper surface parallel to the roof of the respective rail, a first and a second guide wheel spaced longitudinally of the respective rail and mounted for rotation about an axis at right angles to the roof and having a periphery arranged to engage a surface at right angles to the roof of the respective rail, edges of the periphery of the guide wheels being spaced on opposed sides of a plane containing the points of contact between the periphery of the support wheels and the upper surface of the rail, and a counterweight means on said support portion spaced from said first wheel assembly on the side thereof remote from said scaffold portion and arranged to provide sufficient moment about said first wheel assembly to maintain said support wheels of said second wheel assembly in contact with said second rail.

This aspect of the invention therefore provides a particular form of wheel arrangement which cooperates with the counterweight so that the support portion can readily be mounted upon the roof of the building and is readily adjustable to suit different rail or purlin arrangements. The wheel arrangements using the support wheels and the guide wheels arranged at right angles thereto enable the device to run on various shapes of rail without the necessity for modification or adjustment.

According to a second aspect of the invention there is provided a mobile suspended scaffold arrangement comprising a support portion for running along a roof of a building and a scaffold portion arranged to be suspended from said support portion along a side wall of the building, said support portion comprising a first wheel assembly for running along a first rail adjacent an edge of the roof, a second wheel assembly for running along a second rail parallel to the first and spaced on the edge of the roof, frame means interconnecting the first and second wheel assemblies so that the support portion forms a platform, said support portion comprising a pair of first wheel assemblies and a pair of second wheel assemblies and a pair of frame means each interconnecting a respective one of the pairs of first and second wheel assemblies thus forming two separate dollies movable separately along the roof on said first and second rails and means for connecting said first and second dollies to form an integral support portion for said scaffold portion.

This aspect therefore provides an improved construction of the support portion which enables it to operate not only as a support for the scaffold portion but also to form a pair of dollies which can be used in carrying roof panels for use in the cladding of the roof in the conventional steel building construction. Preferably the dollies are formed by splitting the support portion in the form of a platform into two separate halves in a direction at right angles to the rails so that two halves can continue to run on the rails and each half can be used to carry various pieces of equipment used in the roof cladding process.

According to a third aspect of the invention there is provided a mobile suspended scaffold arrangement comprising a support portion for running along a roof of a building and a scaffold portion arranged to be suspended from said support portion along a side wall of the building, said support portion comprising a first wheel assembly for running along a first rail adjacent an edge of the roof, a second wheel assembly for running along a second rail parallel to the first and spaced on the edge of the roof, frame means interconnecting the first and second wheel assemblies so that the support portion forms a platform, said scaffold portion comprising a pair of rigid suspension members each supported from said support portion at a position spaced therealong longitudinally of said rail, each of said suspension members being attached to said support portion at two positions thereon spaced in a plane lying at right angles to the rail whereby the suspension members are held rigid relative to said support portion.

This aspect therefore provides an improved connection between the scaffold portion and the support portion so that the scaffold portion is held rigid as opposed to the conventional swinging cable supported scaffold portions of the prior art. This arrangement enables the device to operate most effectively for its intended purpose of supporting an operative suitably at a position adjacent the wall or junction between the wall and the roof so that he can operate upon the part for cladding or other operations as required while being supported in a manner which allows movements and forces to be applied without the scaffold portion swinging about.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred embodiment of the principles of the present invention, in which:

DESCRIPTION OF THE DRAWINGS

In the drawings like characters of reference indicate corresponding parts in the different figures.

DETAILED DESCRIPTION

Basically, this device is an apparatus used to aid in the application of metal cladding onto prefabricated metal structures, although it can readily be used on other types of buildings as well. The device is a mobile and portable framework which rides along the roof structural members of the building while supporting, during part of its operation, a platform for workers.

Figure 2:
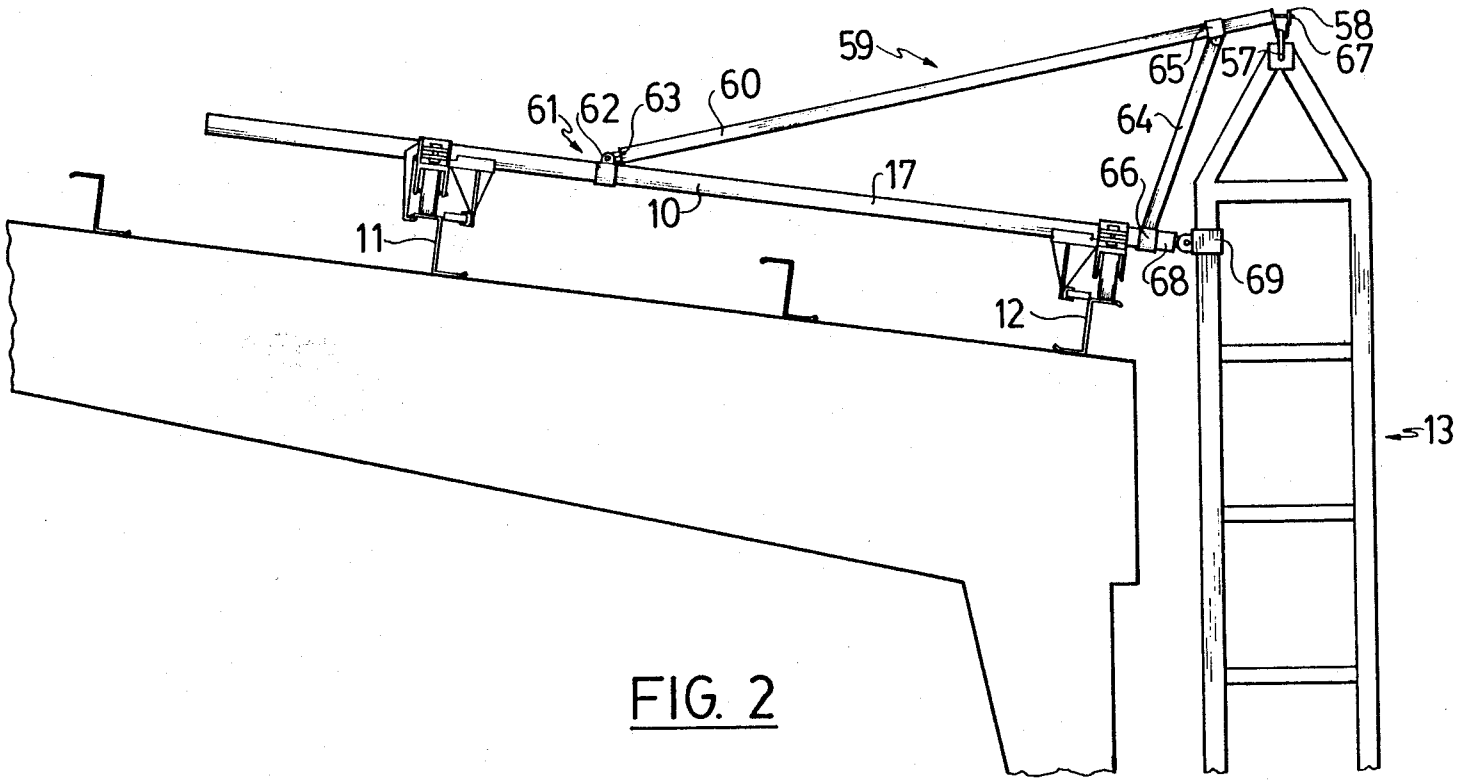
FIG. 2 is a side elevational view of the apparatus of FIG. 1 the rails mounted upon a building structure.

The apparatus comprises generally a support portion indicated at 10 which can be mounted upon the roof purlins 11 and 12 and a scaffold portion generally indicated at 13 which is suspended from the support portions so as to depend over the side of the building beyond the edge of the roof as best shown in FIG. 2.

The support portion comprises a pair of dolley members 14 and 15 which are effectively identical and symmetrical about a central axis lying at right angle to the rails 11 and 12. Each of the dollies comprises a frame structure in the form of a pair of straight parallel beams 16 and 17 which are connected to a front wheel assembly 18 and a rear wheel assembly 19.

Figure 4:
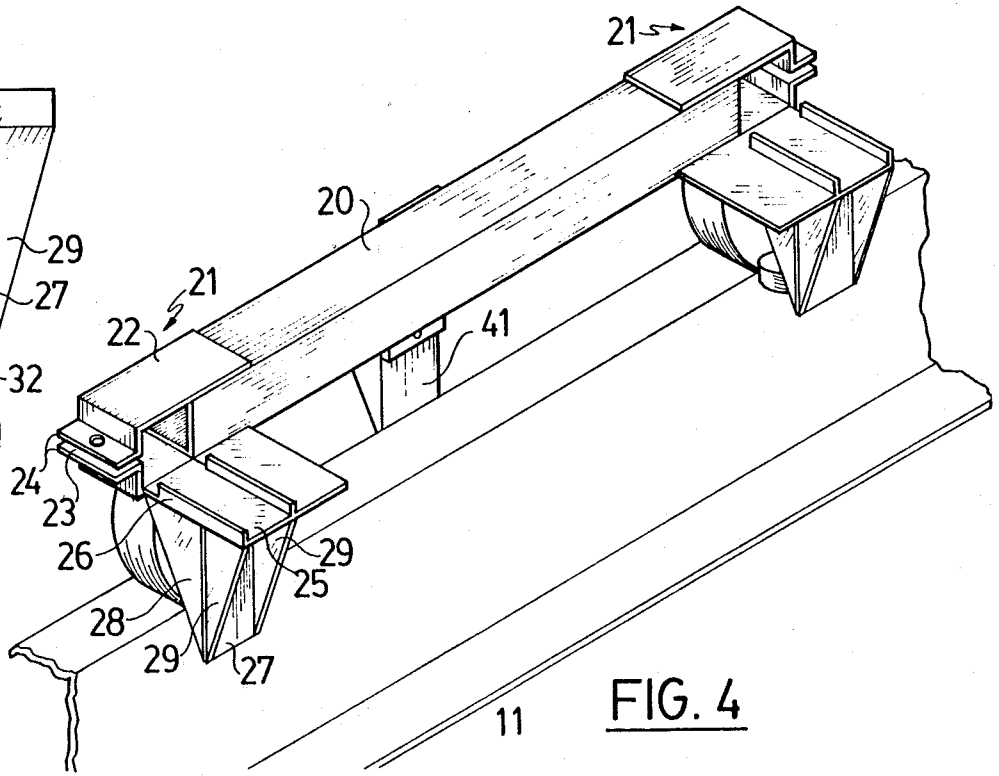
FIG. 4 is an isometric view on an enlarged scale of the second wheel assembly also shown in FIG. 3.
Figure 3:
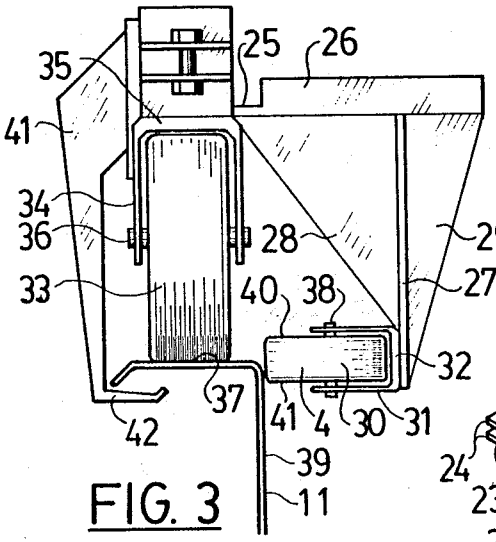
FIG. 3 is a side elevational view on an enlarged scale of the second wheel assembly of the apparatus of FIGS. 1 and 2.
Figure 5:
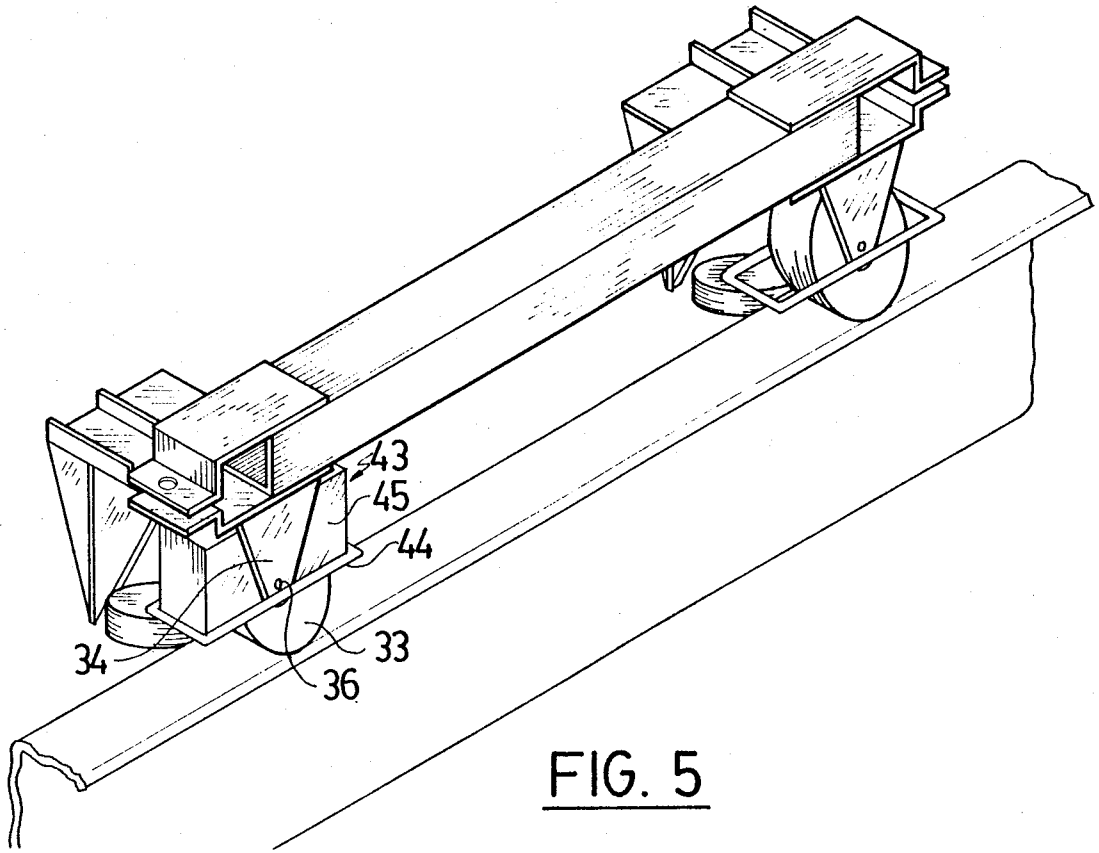
FIG. 5 is an isometric view similar to that of FIG. 4 showing the first or front wheel assembly of the apparatus of FIGS. 1 and 2.
Figure 6:
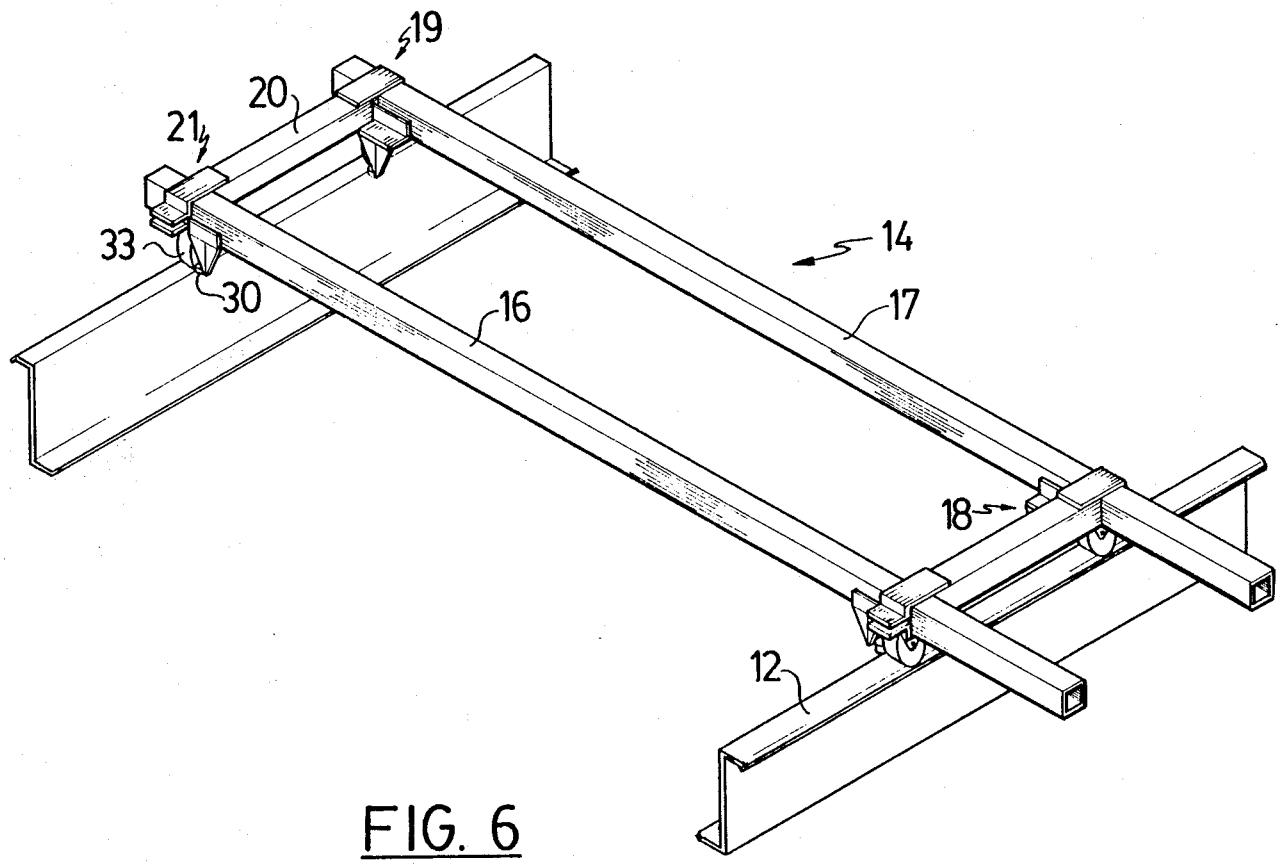
FIG. 6 is an isometric view similar to that of FIG. 1 on an enlarged scale showing a single one of the dollies forming part of the support portion of the apparatus of FIG. 1.

The most basic component of the apparatus is the wheel assembly or castor assembly illustrated in most detail in FIGS. 3, 4 and 5. Each wheel assembly comprises a rigid axle 20 which extends parallel to and above the rail and is formed by a tubular beam. The beam 20 carries on each end a loop portion 21 formed by an upper bracket 22 and a lower bracket 23 which define between them an opening for a respective one of the frame beams 16 and 17. The brackets 22 and 23 terminate in spaced flanges 24 which can be clamped together by a bolt so as to clamp the brackets around the beam 16, 17 to retain the wheel assembly at a required position along the length of the respective beam 16, 17.

The lower bracket 23 projects outwardly to one side thereof as indicated at 25 to define a platform for resting against another side of the respective beam 16, 17. The platform 25 has upstanding side walls 26 which act to confine the beam 16, 17 and retain the axle 20 properly at right angles to the beam an to prevent any twisting of the axle 20 about an axis longitudinally thereof relative to the beams 16 and 17.

A plate 27 extends downwardly from the underside of the platform 25 and is supported by triangular webs 28 and 29 at both ends thereof. The plate 27 thus defines a support for a guide wheel 30 which is carried in a yoke 31 a base 32 of which is clamped to the plate 27. A support wheel 33 is mounted upon a yoke 34 which also includes a base plate 35 attached directly to the underside of the bracket 23. Thus the axle 36 of the wheel 33 lies urgently horizontal direction with a periphery of the wheel 33 arranged to run on an upper surface 37 of the purlin 11. The axle 38 of the wheel 30 is arranged at right angles to the axle 36 that is generally vertically so that the periphery of the wheel 30 lies in a substantial vertical plane for running against a vertical side surface 39 of the purlin 11. The upper and lower edges 40 and 41 of the wheel 30 are arranged so that they lie in planes spaced on either side of the lowermost point of the periphery of the wheel 33 so that the periphery of the wheel 30 necessarily runs against an edge of the surface 37 whether that edge be part of the purlin which is Z-shaped as shown or part of another structure for example a rectangular tube, an eye beam or the like.

The support wheel 33 rides along the horizontal member or purlin of the building structure and thereby supports and mobilizes the apparatus. The keeper or guide wheel is positioned so as to restrict movement of the apparatus to horizontally traverse. The right angle configuration of the support wheel on he guide wheel allows the castor assembly to cooperate with virtually any structural shape.

The rigid axle member 20 may be of any suitable length but in one preferred arrangement is of the order of three feet in length which provides a usable dolley for supporting for example roof cladding. The length of the axle 20 may be adjustable if required. It will be noted that the guide wheels 33 of one of the wheel assemblies are arranged on the same side of the support wheels so that the drive wheels run along the same edge of the roof structural member and can simply be placed against that edge by lowering the wheel assembly onto the respective rail.

The loop members 21 by their design when secured or tightened by the bolts (not shown) will maintain the beam 16 and 17 in a fixed position. Each individual wheel assembly may be reversed relative to the beam 16 and 17. However under normal conditions the base frame unit or dolley would be assembled as illustrated with the front wheel assembly arranged so as to restrict motion toward the exterior of the building and the rear wheel assembly arranged so as to restrict movement toward the interior of the building. By the nature of the beams and wheel assemblies as previously described, the dolley thus forms a rigid rectangular shape which can be adjusted in length so that the unit becomes effectively locked between these structural members with which it cooperates, while transverse mobility is unrestricted.

The front wheel assembly and the rear wheel assembly are effectively identical in their construction and operation. They do differ however in that each incorporates unique features which distinguish their purpose and position in the base assembly. The rear wheel assembly is fitted with a safety hook 41 which is positioned on the axle 20 and is bolted thereto at a point midway along its length that is between the two support wheels 33. The hook member includes a downwardly projecting portion and a rearwardly projecting hook 42 which extends beneath the upper surface 37 of the purlin 11. The depth of the downward projection can be adjustable by adjusting the position of bolting of the upper portion to the axle 20. In addition the hook can be adjusted towards or away from the axle. In this manner the safety hook may be positioned so that it is immediately adjacent to but spaced from the structural member and particularly the upper surface 37 thereof. Under normal conditions the safety hook does not in any way affect the operation or movement of the base frame assembly. Its sole purpose is to offer an additional margin of safety by restricting upward vertical motion at the rear extreme of the support frame assembly so as to prevent the whole frame assembly from toppling from the building by pivotal movement about the front wheel assembly.

The front wheel assembly includes brake mechanisms schematically indicated at 43 in the form of wedge members which can be inserted between the upper surface of the support wheel 33 and the yoke 34. Thus manual pivoting of a rack 44 about the axle 34 of the wheel 33 causes a wedge member 45 carried thereby to be inserted into that area to cause jamming of the wheel 33 to halt movement of the unit along the rails.

In addition the wedge members 45 operate effectively as a brake in a situation where the rails are mounted at the gable ends of the building so the rails are inclined to the horizontal. The whole unit is thus prevented from running down the gable end by the operation of the wedge members 45 which halt the wheels until the wedge members are moved manually to allow the unit to roll along the rail as required by the operative.

The weight of the scaffold portion 13 and the operatives thereon together with any tools they may be using is counterbalanced about an axis defined by the front wheel assemblies by a counterweight mounted at a rearwardmost end of the beam 16 and 17 and indicated at 46. The counterweight is calculated to be of a suitable mass bearing in mind the very much greater mechanical advantage so that the unit can accommodate the required amount with of course a suitable safety factor.

It will be appreciated therefore that the support member constituted by the dollies 14 and 15 connected together can simply be lowered onto the rails without any necessity for adjustment of wheels or connection of wheels beneath rail portions and can simply sit on the rails for movement therealong without any possibility of twisting or pivoting.

The two dollies 14 and 15 are connected together simply by straps 47 and 48 which connect into the bolts clamping the loop members indicated at 21A and 21B which lie adjacent at the center between the two dollies.

The dollies can be separated simply by disconnecting the straps 47 and 48 from one of the associated loop rails 11 and 12. The utilization of two or more base frames or dollies cooperated in a single unit affords many advantages. The overall size of the device when expanded offers portionally greater working area. The expanded configuration allows for a greater degree of stability. A subsequent employment of additional support wheels provides a greater loading capacity as well as a more effective load distribution. The subsequent employment of extra guide wheels also improves the stability and thus the effectiveness of the device.

Because each base frame unit or dolley is identical, any number of these units may be linked together in a modular fashion to accommodate any situation. Conversely the number of units can be reduced as required.

When the dollies are separated they may be employed individually or in corporation with one another to provide a variety of services. Basically they become portable and mobile working surfaces easily positioned anywhere on the building roof structure which provide a expanded accessibility for the placement of component members. The dollies may also be used to transport roof cladding along the roof plane. The adjustability and reversible capabilities of the wheel assemblies ensure that the base frames can be employed virtually anywhere on the roof regardless of purlin shape, size or spacing.

Figure 1:
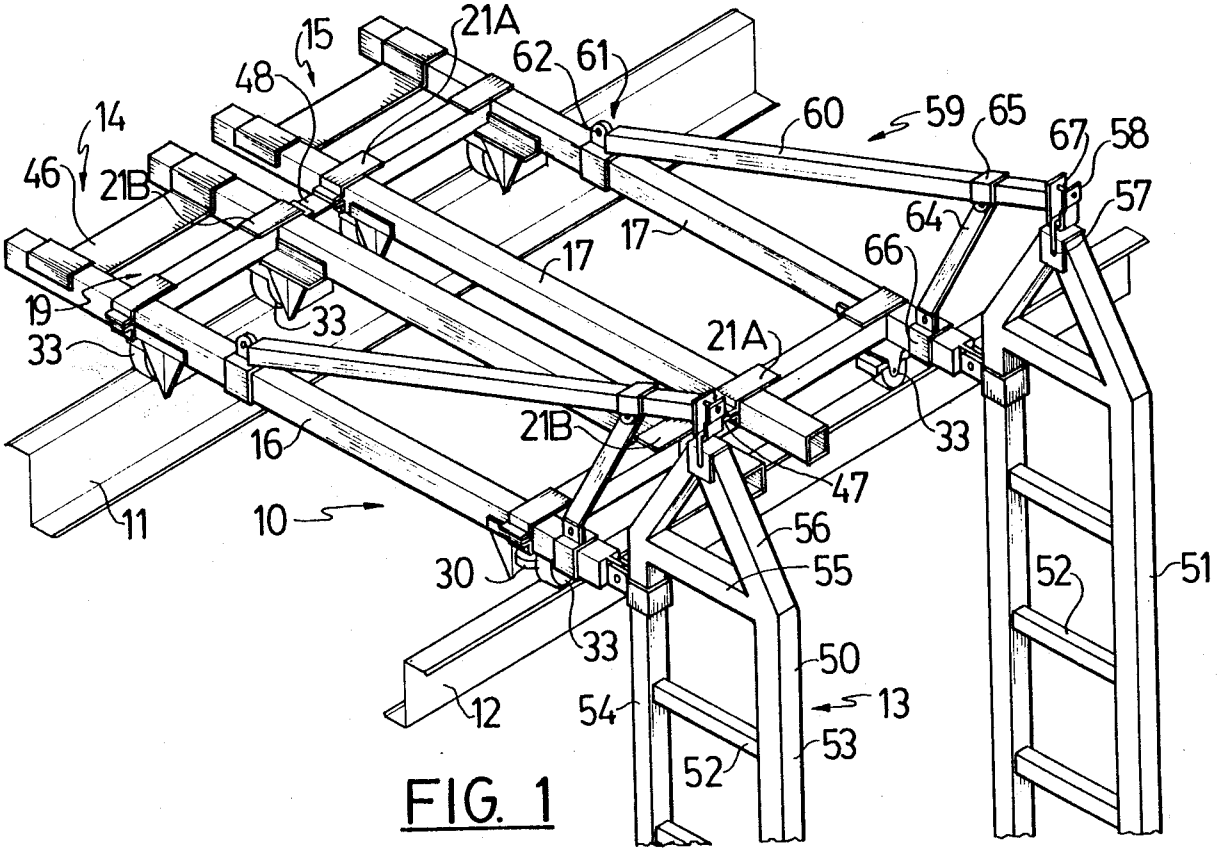
FIG. 1 is an isometric view of the whole of the scaffold arrangement mounted upon the roof of a building with the roof being shown only as a pair of rails.

As shown best in FIGS. 1 and 2 the scaffold portion 13 comprises a pair of rigid laddler-type supports 50 and 51 which have transverse rungs 52 for supporting planks or flooring upon which an operative can stand. Each ladder support includes a pair of rigid uprights 53, 54, a transverse strut 55 and inwardly inclined support beams 56 which connect at an upper apex. A loop 57 is welded at the apex for attachment over a hook 58 of the support frame. The length of the loop 57 may be adjustable by providing a number of separate loops or by clamping the loops to the apex in such a manner that it may be movable relative thereto. This allows the height of the respective ladder support to be adjusted relative to the support frame. This is particularly useful when the support frame is mounted on rails at the gable end of the building since the inclination of the gable end can be accommodated by adjusting the height of the apex of one of the ladder supports so as to retain the flooring connecting the rungs 52 at a horizontal level.

The hook 58 is mounted on a boom assembly generally indicated at 59 carried on the beams 16 and 17 of the support frame. Each boom 59 comprises an elongate beam 60 which has a bracket 61 at a lower end relative to which the beam 60 can pivot. The bracket 61 is of the type which includes three sides which surround the beam 17 so that when loose it can slide along the beam 17 but can be clamped into frictional engagement therewith by a bolt which connects together flanges 62 of the bracket. The flanges 62 receive therebetween an ear 63 projecting outwardly from the end of the beam 60 so that when loose the beam 60 can slide along the beam 17 and can pivot relative thereto.

The beam 60 is supported at an angle relative to the beam 17 by a strut 64 which carries at an upper end a bracket 65 and at a lower end a bracket 66 both of which are similar in construction to the bracket 61. Thus the angle and position of the beam 60 can be adjusted by sliding each of the brackets 61, 65 and 66 and then can be locked into place by tightening the respective bolts to the clamp the brackets around the respective beam. The hook 58 is welded to the end of the beam 60 so as to project outwardly therefrom and to define a cup for receiving the loop 57 of the respective ladder support. A transverse pin 67 can be mounted in place to close the hook 58 after the loop is properly located to prevent any possibility of disengagement between the hook and loop.

The ladder support is also attached to the beam 17 by way of a strut 68 which is slidable within an open end of the beam 17 at the end thereof adjacent the edge of the roof. The position of the strut 68 within the beam 17 can be adjusted and locked by any suitable mechanism. Attached to an outer end of the beam 68 is a bracket 69 of the same construction as the bracket 61 and which clamps around one leg of the ladder support. Thus the ladder support is held rigidly at two separate points by the support structure on the roof so that it is prevented from swinging or twisting relative to the hook 58.

In an initial assembly of the boom structure on the roof support, the clamps are still loose and do not restrict adjustment of the boom assembly. As the boom assembly is essentially a triangular configuration, it offers the greatest degree of structural integrity. With the clamps unsecured, the three sides of the triangle formed are completely adjustable with respect to boom angle. In addition the entire boom may be allowed to move along the length of the beam 17. The projection of the boom past the building wall is more or less established by the positioning of the rear of the boom and the corresponding clamp. Sufficient pressure may be applied by tightening the structural fastener of the clamp so as to maintain the clamp in a fixed position relative to the base rail while still allowing the boom to pivot on that bolt. Desirable boom angle is achieved by adjusting the boom strut.

It should be noted that the boom assembly 59 is positioned at the outermost beam 16 of the dolley 14 and the outermost beam 17 of the dolley 15 thus spacing the ladder supports as far apart as possible which in the example shown will be of the order of seven feet. Further spacing can be achieved by introducing further dollies which are then clamped together as previously described. In addition if only a single person is required to work on the scaffold, the boom can be moved to the beam 17 of the dolley 14 so that the scaffold portion is supported on a single one of the dollies providing a working width between the ladder supports of the order of three feet.

Cross braces (not shown) can be connected between the boom 59 adjacent the hook 58 and the beam 16 or 17 of the other boom of the pair. This provides an X-brace retaining the booms at the required spacing to prevent any twisting of the whole unit.

The boom assembly utilizes a corresponding base rail in order to accomplish its structural effectiveness. The fittings on all component members have been designed to be interchangeable. Therefore any boom or boom strut may be used in conjunction with any base rail to effectively accomplish a boom assembly. For complete rigidity of the unit, employment of X-bracing (not shown) can be provided between the ladder supports interconnecting the outer legs thereof. The scaffold portion illustrated is a basic unit designed to be used on all structures. It is of sufficient length to provide average access for workers in the vertical plane. As buildings can vary in height or elevation, it follows that the ladder supports must be equipped to accommodate such variations. Secondary ladder supports may be added to the described unit in order to expand the overall length thereof in a modular fashion.

The device in its fully assembled form is basically designed to expedite the cladding process with regard to the side walls of prefabricated metal buildings. The horizontal lay of the eave member purlins allows the mechanism to roll from side to side in a relative stable manner. The end walls or gable ends of most prefabricated buildings have a slope built into shed water. By convention this slope is either 1:12 or ¼:12 as a standard, although other slopes are often engineered to suit special situations. Because the roof structurals or purlins are situated so that their length is at right angles to the end walls and because these purlins step down from the horizontal in accordance with the corresponding roof pitch, the roof structurals are not suitable to maintain the operation of the device as described. However, the wheel assemblies are designed to cooperate with virtually any structural shape. There it is no great task to temporarily attach suitable rails to the roof structure parallel to the end wall plane supported by the standard building purlins. As the wheel assemblies are completely adjustable relative to the frame, any convenient spacing of the temporary rails may be used provided of course that they remain parallel to one another.

Because these devices utilizes a counterweight system to maintain stability in the horizontal plane, it would seem logical that a mechanism could also be used for procedures related to walls after the roof cladding has been placed. There are numerous functions which can only be initiated after the roof and walls are installed. Placement of eave trim and/or gutter is the most obvious example. In most instances the cladding procedures begins with the wall cladding placement immediately followed by placement of the roof. However it is not unusual for the customer to request that the roof be placed first and then the walls so that he can perform certain interior functions under the shelter, or that the walls be left until certain machinery can be moved into the building before the walls are closed in. The device has therefore been designed with these variations in mind. The flexibility of the apparatus provided by the specific design of the wheel assemblies, the separation of the unit into two separate dollies and the various adjustabilities allow the unit to be used in various different circumstances in this general field. In addition the rigid support of the hangers or ladder supports provide a very safe working environment for the operatives and allows them to apply forces to the building and to move on the flooring without danger of the unit moving or toppling.

Since various modifications can be made in my invention as hereinabove described, and many apparently different embodiments of same made within the spirit and scope of the claims without departing from such spirit and scope, it is intended that all matter contained in the accompanying specification shall be interpreted as illustrative only and not in a limiting sense.

I claim:

1. A mobile suspeneded scaffold system for use on a building having a roof, a wall extending along an edge of the roof, and spaced apart, parallel first and second rails extending along the roof parallel to said edge thereof, with the second rail being further from the roof edge than the first, said system comprising a support portion for running along the roof parallel to the edge and a scaffold portion supported by said support portion comprising a first wheel assembly for running along the first rail, a second wheel assembly of substantially the same configuration as the first wheel assembly for running along the second rail frame means including at least two elongated frame members extending transversely of the rails and interconnecting the first and second wheel assemblies so that the support portion forms a platform, each of said wheel assemblies comprising a beam parallel to the rail, attachment means detachably and adjustably securing the beam to the frame members, thereby interconnecting the frame members to form a platform therewith, a first and a second support wheel spaced longitudinally of the beam, and each mounted for rotation about an axis parallel to the roof and having a periphery arranged to run on an upper surface parallel to the roof of the respective rail, a first and second guide wheel spaced longitudinally of the beam and mounted for rotation about an axis at right angles to the roof and having a periphery arranged to engage a surface of the respective rail at right angles to the roof, the periphery of each guide wheel extending to both sides of a plane containing the upper surface fo the rail, and a counterweight means on said support portion spaced from said first wheel assembly on the side thereof remote from said scaffold portion and arranged to provide sufficient moment about said first wheel assembly to maintain said support wheels of said second wheel assembly in contact with said second rail wherein said support portion includes at least two booms extending upwardly and outwardly from respective frame members, and strut means pivotally supporting each boom, clamp means pivotally connecting each boom and strut means to their respective frame member, each clamp means having a release condition allowing independent sliding movement of said booms and strut means along their associated frame member to adjust their inclination and position thereto and a clamp condition in which the associated boom or strut means is secured to a fixed location on the frame member.

2. The invention according to claim 1 wherein said attachment means comprise means for selectively attaching the wheel assembly to said frame to allow members in a first position with said guide wheels arranged on an inner side of the rail remote from the edge of the roof and in a second position with the guide wheels arranged on an outer side of the rail adjacent the edge of the roof.

3. The invention according to claim 1 wherein said attachment means comprise a pair of loop members carried by each beam for receiving respective ones of the frame members and means for clamping said loop members to the respective frame members at selected positions therealong.

4. The invention according to claim 1 wherein said support portion comprises two separable dollies with each dolly comprising two said frame members and first and second wheel assemblies.

5. The invention according to claim 1 wherein said first wheel assembly includes brake means manually operable by a person standing on said scaffold portion.

6. The invention according to claim 1 wherein said second wheel assembly includes a hook member arranged to extend therefrom to a position underneath said upper surface of said respective rail to prevent any possibility of pivoting of said support portion about said first wheel assembly.

7. The invention according claim 1 wherein said scaffold portion comprises a pair of rigid suspension members supported solely from said support portion at positions spaced longitudinally of said rail and spaced from the wall, and said support portion includes first support means connecting each of said suspension members to said support portion and preventing relative vertical movement of the suspension members and the support portion, and second support means vertically spaced from the first support means, connecting the suspension members of the support portion and preventing relative horizontal movement of the suspension members and the support portion whereby the suspension members and the support portion whereby the suspension members are held rigid relative to said support portion.

8. The invention according of claim 7 wherein said first support means including means directly connecting each suspension member of said booms at an upper support position outwardly of said roof edge and said second support means including said support portion and engaging each said suspension member at slower support position downwardly of said upper support position.

9. The invention according of claim 8 wherein shook in the end of each boom outwardly of said roof edge, an upper loop on each suspension member engaged on the hook of a respective boom, said second support means including members projecting from the frame members and grasping downwardly depending legs of said suspension members.

10. A mobile suspended scaffold arrangement comprising a support portion for running along a roof of a building and a scaffold portion arranged to be suspended from said support portion along a side wall of the building, said support portion comprising a first wheel assembly for running along a first rail adjacent an edge of the roof, a second wheel assembly for running along a second rail parallel to the first and spaced from the edge of the roof, at least two frame members interconnecting the first and second wheel assemblies and forming a platform there with, two booms extending upwardly and outwardly from respective frame member to respective upper support positions above the first wheel assembly, spaced outwardly of the roof edge and spaced from one another longitudinally of the rails, strut means extending between and connected to each boom and the associated frame member, and supporting the boom, clamp means pivotally connecting each boom and strut means to their respective frame member, each clamp means having a release condition allowing independent sliding movement of said booms and strut means along their associated frame member to adjust their inclination and position thereto and a clamp condition in which the associated boom or strut means is secured to a fixed location on the frame member, two lower support members projecting outwardly from the frame members to respective lower support positions spaced vertically below the respective upper support portions, said scaffold portion comprising a pair of rigid suspension members at positions spaced therealong longitudinally of said rails, upper connecting means connecting said suspension members to respective ones of the booms at the upper support positions, and lower connecting means connecting the suspension members to the respective lower support members at the lower support positions, the upper and lower connecting means co-acting to hold the suspension members rigid relative to said support portion.

11. The invention according to claim 10 wherein a hook on an outer end of each boom and upper loops on said suspension members supported by the respective hooks, and members projecting from the frame members and grasping downwardly depending legs of said suspension members.

* * * * *